US007222695B2

(12) United States Patent
Jules et al.

(10) Patent No.: US 7,222,695 B2
(45) Date of Patent: May 29, 2007

(54) LADDER LEVELLER

(76) Inventors: Leona B. Jules, Box 1031, Barriere, British Columbia (CA) V0E 1E0; Richard K. Whittingham, Box 1031, Barriere, British Columbia (CA) V0E 1E0

( * ) Notice: Subject to any disclaimer, the term of this patent is extended or adjusted under 35 U.S.C. 154(b) by 110 days.

(21) Appl. No.: 11/190,835

(22) Filed: Jul. 28, 2005

(65) Prior Publication Data

US 2007/0023234 A1 Feb. 1, 2007

(51) Int. Cl.
*E06C 1/00* (2006.01)

(52) U.S. Cl. ..... 182/200

(58) Field of Classification Search ..... 182/200, 182/201, 202, 203, 204, 205; 248/188.2, 248/188.3

See application file for complete search history.

(56) References Cited

U.S. PATENT DOCUMENTS

| | | | | |
|---|---|---|---|---|
| 1,290,732 | A | 1/1919 | Gants et al. | |
| 1,499,300 | A | 6/1924 | Hayes | |
| 1,609,257 | A | 11/1926 | Lazear | |
| 1,624,945 | A * | 4/1927 | Glover | 182/204 |
| 1,862,171 | A | 6/1932 | Baker | |
| 2,517,771 | A | 8/1950 | Stefano | |
| 3,165,170 | A * | 1/1965 | Blaney | 182/203 |
| 3,447,631 | A | 6/1969 | Smith | |
| 3,998,293 | A | 12/1976 | Raia | |
| 4,014,406 | A | 3/1977 | Easton | |
| 4,607,726 | A | 8/1986 | Davis et al. | |
| 4,852,689 | A | 8/1989 | Erion | |
| 4,984,655 | A | 1/1991 | Scherer et al. | |
| 5,094,320 | A * | 3/1992 | Deitz et al. | 182/204 |
| 5,121,813 | A | 6/1992 | Funston | |
| 5,232,067 | A | 8/1993 | Griffith | |
| 5,325,936 | A * | 7/1994 | Baker | 182/204 |
| 5,476,153 | A | 12/1995 | Dickerson et al. | |
| 5,542,497 | A | 8/1996 | Macyszyn | |
| 5,553,963 | A | 9/1996 | Hoy et al. | |
| 5,678,656 | A * | 10/1997 | Lanzafame | 182/205 |
| 5,718,306 | A * | 2/1998 | Baker | 182/204 |
| 6,293,367 | B1 | 9/2001 | Gulseth | |
| 6,374,947 | B1 | 4/2002 | Nurkiewicz | |
| 6,435,306 | B2 | 8/2002 | Stoneberg | |
| 6,595,326 | B1 * | 7/2003 | Dean | 182/204 |
| 6,948,591 | B2 * | 9/2005 | Scott et al. | 182/201 |
| 7,036,633 | B2 * | 5/2006 | Lanzafame | 182/200 |

FOREIGN PATENT DOCUMENTS

| | | |
|---|---|---|
| CA | 2274330 | 2/1942 |

* cited by examiner

*Primary Examiner*—Hugh B. Thompson, II
(74) *Attorney, Agent, or Firm*—Antony C. Edwards

(57) ABSTRACT

A ladder leveller for mounting onto at least one stile of a hollow runged ladder includes an elongate stile extension member, a cross bar sized for mounting journalled through a hollow rung of the ladder. A locking pin extends from the cross bar, through one of an array of apertures in the extension member and cooperates with a locking bar. The locking bar is releasably mounted onto the locking pin to lock the stile extension member onto the stile.

12 Claims, 14 Drawing Sheets

LADDER LEVELLER

FIELD OF THE INVENTION

This invention relates to extension ladder attachments comprising a movable and adjustable stile extension that engages the ladder via hollow ladder rungs, for the purpose of using a ladder on uneven surfaces.

BACKGROUND OF THE INVENTION

Ladders are used extensively in construction and maintenance tasks on construction sites and in buildings by a variety of trades and home do it yourself people. Used both indoors and out, ladders are often needed in locations and positions where the footing upon which they rest is uneven. Indoor stairwells present a particular problem for painters, electricians, etc. for accessing walls and ceilings. Out of doors uneven ground around a building or structure upon which work is to be performed poses a significant challenge in terms of safe ladder use. Many solutions to this problem have been devised including ladders with independently telescoping legs of various design, and ladder attachments that incorporate telescoping legs for the purpose of leveling a ladder on uneven surfaces.

Applicant is aware of patents regarding adjustable ladders and ladder attachments that provide support to the ladder so that each leg may adequately engage the supporting uneven surfaces:

| Patent | Country | Inventor | Patented |
|---|---|---|---|
| 1,609,257 | USA | Lazear | 25 May 1926 |
| 3,998,293 | USA | Raia | 21 Dec. 1976 |
| 4,852,689 | USA | Erion | 01 Aug. 1989 |
| 4,984,655 | USA | Scherer, et al. | 15 Jan. 1991 |
| 5,476,153 | USA | Dickerson, et al. | 19 Dec. 1995 |
| 1,290,732 | Canada | Veness | 15 Oct. 1991 |
| 2,274,330 | Canada | Batten | App Jun. 3, 1999 |
| 1,499,300 | USA | Hayes | 24 Jun. 1924 |
| 1,862,171 | USA | Baker | 07 Jun. 1932 |
| 2,517,771 | USA | Stefano | 08 Aug. 1950 |
| 3,447,631 | USA | Smith | 03 Jun. 1969 |
| 4,607,726 | USA | Davis, et al. | 26 Aug. 1986 |
| 5,094,320 | USA | Deitz, et al. | 10 Mar. 1992 |
| 5,121,813 | USA | Funston | 16 Jun. 1992 |
| 5,232,067 | USA | Griffith | 03 Aug. 1993 |
| 5,542,497 | USA | Macyszyn | 06 Aug. 1996 |
| 5,553,963 | USA | Hoy, et al. | 10 Sep. 1996 |
| 6,293,367 | USA | Gulseth | 25 Sep. 2001 |
| 6,374,947 | USA | Nurkiewicz | 23 Apr. 2002 |
| 6,435,306 | USA | Stoneburg | 20 Aug. 2002 |
| 4,014,406 | USA | Easton | Mar. 29, 1977 |

The fore-mentioned patents teach a variety of methods to make ladder legs adjustable in order to compensate for uneven supporting surfaces. Some require tools to attach the ladder leveling device, while others can be applied without tools. Some are mounted through the rung of a hollow rung ladder, while others are affixed to the outside of the rung or the main ladder frame or stiles. Some are easily removed while others are not. Some insulate the ladder primarily by means of a rubber foot pad, while others are not. Some are adjustable and positively secured, with some being easily quick and easy to adjust, while most are not. Many require permanent modification of the ladder being attached to.

SUMMARY OF THE INVENTION

The present invention provides the means to use a hollow rung ladder on uneven surfaces by attachment of one or more extendible legs to the ladder stiles. One common application where the invention may be used on uneven surfaces is in painting a hallway with a set of stairs in it. The present invention is readily attached to or removed from a ladder without the use of tools or modification of the ladder in any manner. Further the present invention once installed does not interfere with the operation of the ladder where the ladder is an extension ladder Or a step ladder. The present invention attaches to a ladder by passing threaded rods centrally through two adjacent hollow rungs on the lowest extent of the ladder stiles, and securely affixing the rod therein by insulated ladder collars that locate and seat in the ladder rung port, and on the surface of the stile at the ladder rung port. The insulated ladder collar is surfaced with grooves in a manner that provides an interlocking surface with a similarly surfaced extendible leg in the form of u shaped channel. The channel is mated against the ladder collars so as to attain the desired leg extension, and secured thereon by means of a quick-release locking bar, which is guided into position by a cylindrical groove on a locking bar guide. The quick release locking bar eases adjustment of the extendible leg, without the use of tools, while providing a secure means of attaching the ladder leveller to the ladder. This also allows for quick relocation of a single leveller leg from one side, that is stile, of the ladder to the other.

Thus in summary, the present invention may be summarized as a ladder leveller for mounting onto at least one stile of a hollow runged ladder, the leveller including, an elongate stile extension member at least one cross bar sized for mounting journalled through a hollow rung of the ladder, a locking pin extending from the at least one cross bar and cooperating locking bar. The extension member has a spaced array of apertures formed therealong, each aperture of the array extending through the stile extension member.

Cross bar mounts are mountable onto an end of the cross bars in mating engagement with an end of the hollow rung so as to secure the cross bars journalled in the hollow rungs. The cross bars and cross bar mounts extend co-axially from the cross bars and through any one of the apertures in the stile extension member so that the locking pin is exposed outwardly of the stile extension member oppositely disposed relative to the ladder when the stile extension member is abutted against so as to lie along, the corresponding stile. The locking bar is releasably mounted onto the locking pin when extending through an aperture in the stile extension member. The locking pin has locking grooves for interlocking with the locking bar.

Thus, with the cross bars mounted through corresponding hollow rungs, and with the cross bar mounts mounting the cross bars securely in the rungs, and with the locking pin or pins protruding outwardly of the stile, and with the stile extension member mounted along and adjacent the stile with the locking pin protruding through one of the apertures in the stile extension member so as to expose the locking grooves on the locking pin outwardly of the stile extension member, and with the locking bar mated onto the locking grooves on the locking pin, the stile extension member is releasably mounted to and along the stile so as to adjustably extend from a lower end of the stile.

Advantageously, the cross bars extend to opposite ends of the corresponding hollow rungs, and the cross bar mounts mount to opposite ends of each cross bar and corresponding rung, and the locking pins are mounted to, so as to extend oppositely from, the opposite ends of the each cross bar and corresponding rung.

The locking bar may be an elongate rigid member having slotted apertures therein spaced apart so as to coincide with spacing between at least two of the locking pins extending from the corresponding cross bars. The slotted apertures in the locking bar mount simultaneously over the two locking pins so as to engage the locking bar into releasable locking engagement with corresponding the locking grooves in the locking pins.

At least one stop may be mounted on the stile extension member and engageable with the locking bar to limit travel of the locking bar along the stile extension member as the locking bar is mounted into engagement with the locking pins.

Further advantageously, the cross bar mounts are electrically insulating and are mounted onto exposed ends of the cross bars, and the cross bars are of sufficient length to extend outwardly of the corresponding rung so as to expose ends thereof for mounting of the mounts thereto. The mounts mount between the stile extension member and corresponding stile to insulate one from the other. The mounts have outwardly disposed surfaces, disposed outwardly of the corresponding stile. The outwardly disposed surfaces are contoured for inter-locking engagement with a correspondingly contoured surface on the stile extension member so as to inhibit slipping of the stile extension member along the corresponding stile when the stile extension member is mounted thereto. For example, the contoured surfaces may be corrugated such as forming interlocking teeth.

The stile extension member may be a channel member, u-shaped in cross section, so as to form an elongate channel along the length of the member. The locking bar when mounted onto the locking pin is contained within the elongate channel.

In one embodiment, an elongate resilient latch bar is mounted at one end thereof onto the locking bar. The locking bar includes an aperture therethrough disposed underneath a free end of the latch bar. The aperture in the locking bar is sized to mate over the locking pin so as to allow the locking pin to extend therethrough. The latch bar has a mating aperture in the free end thereof for mating over the exposed locking pin exposed through the aperture in the locking bar. The free end of the latch bar is biased by a user lifting it away from the locking bar against a return biasing resiliency of the locking bar so as to mount the mating aperture onto the locking pin. The free end of the latch bar, once released, is resiliently biased so as to return towards the locking bar to thereby releasably lock the locking pin in the mating aperture, thereby mating the locking bar in a locked position relative to the stile extension member and thereby releasably locking the stile extension member onto the corresponding stile of the ladder.

In one embodiment, the aperture in the mating bar is a key slot, and the mating aperture in the latch bar is positioned over a narrow end of the key slot. The narrow end of the key slot engages the locking grooves in the locking pin.

A handle may be formed on the free end of the latch bar adjacent the mating aperture, for grasping by a user so as to bias the free end of the latch bar away from the locking bar.

DETAILED DESCRIPTION OF EMBODIMENTS OF THE INVENTION

Figure 1:
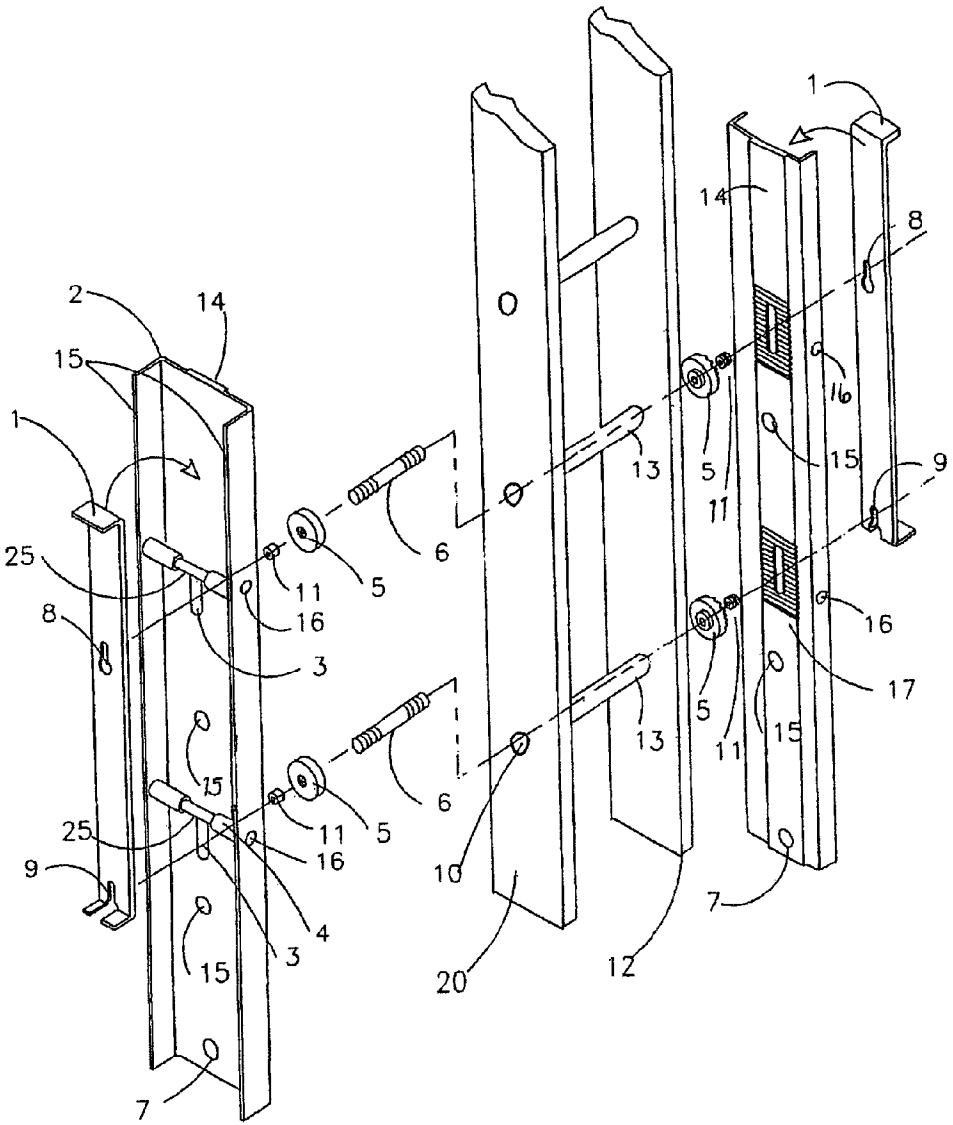
FIG. 1 is, in front perspective view, an exploded assembly for the ladder leveller in alignment of the ladder ports used to attach to the ladder body.

The present invention is a ladder leveling device that attaches to various stile designs of hollow rung ladders and is described with reference to the accompanying drawings wherein similar characters of reference denote corresponding parts in each view. One embodiment of the present invention as seen in FIGS. 1–9 is attached to a ladder 12 by first passing threaded rods 6 centrally through the hollow rungs 13 and securing them in place using insulated ladder collar 5 which has locking pin 11 press fit into it, and together are retained on rod 6 by hand threading the collar and locking pin assembly onto rod 6, and seated by locating ring 19 in the ladder port 10 against the ladder stile 20, with the locking grooves 21 on the collar being positioned normal to the longitudinal axis of the ladder stile 20.

Figure 2:
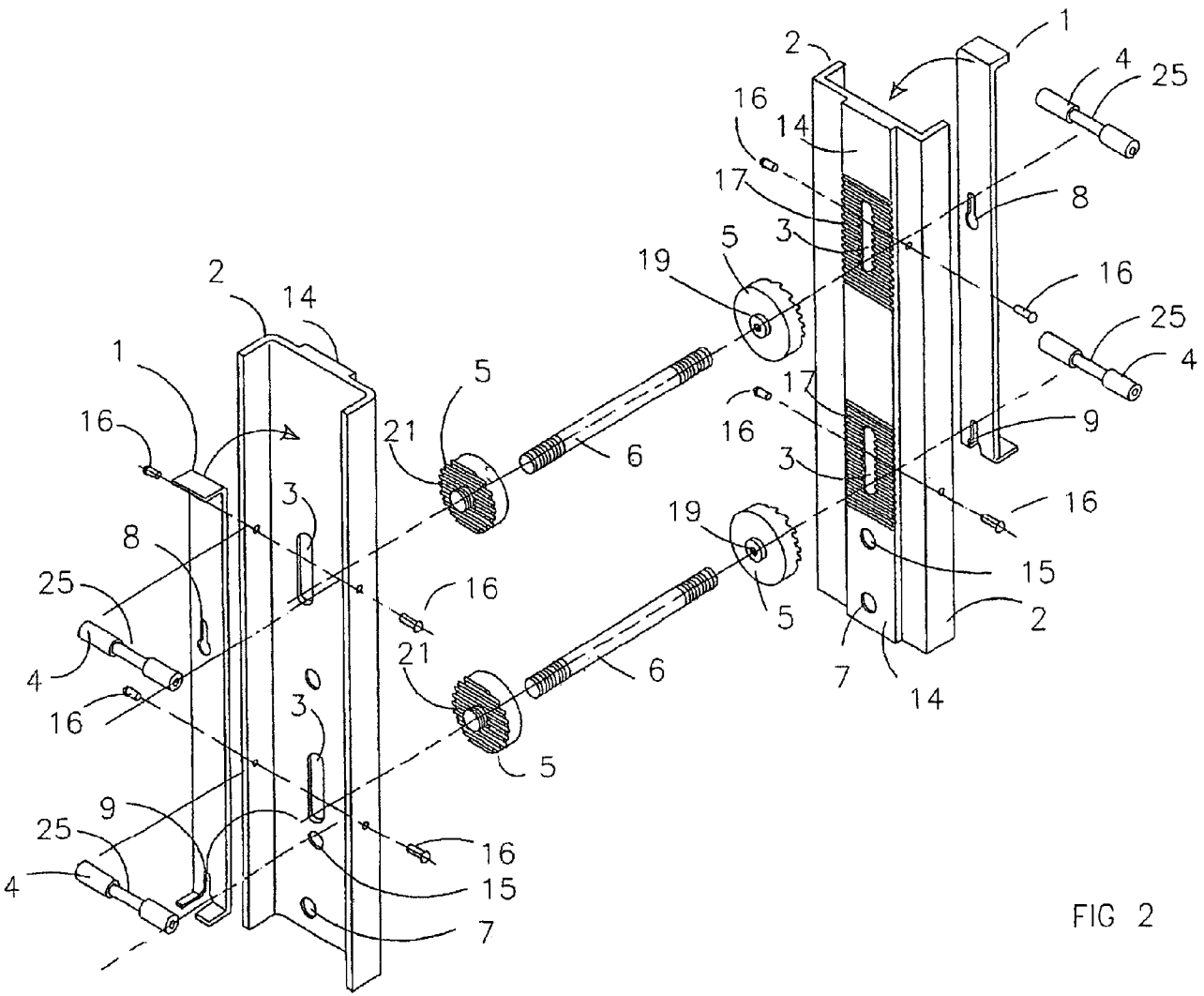
FIG. 2 is, in front perspective view, and exploded assembly of the ladder leveller without a ladder present.
Figure 3:
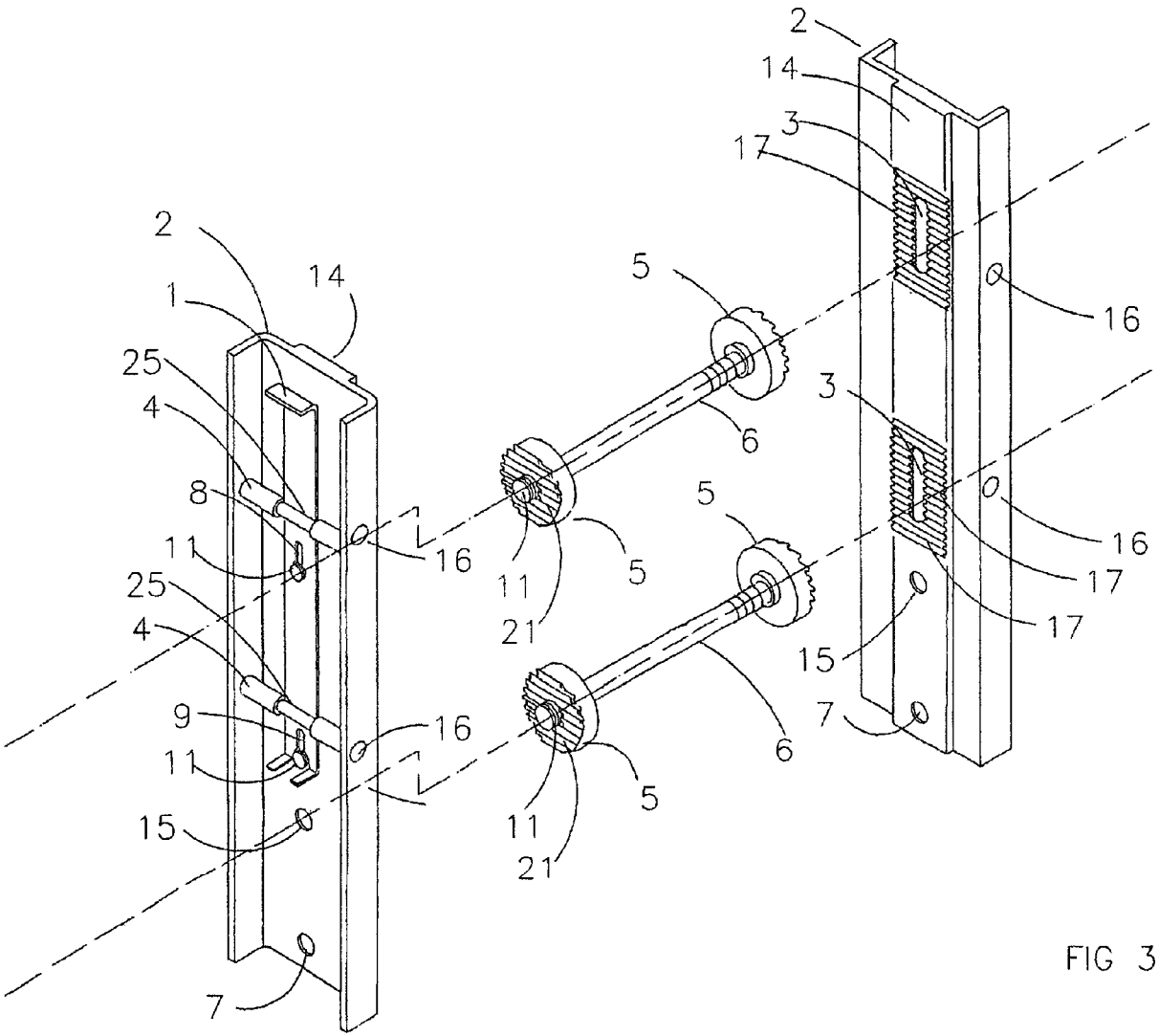
FIG. 3 is, in front perspective view, a partially exploded assembly of the ladder leveller without a ladder present.
Figure 4:
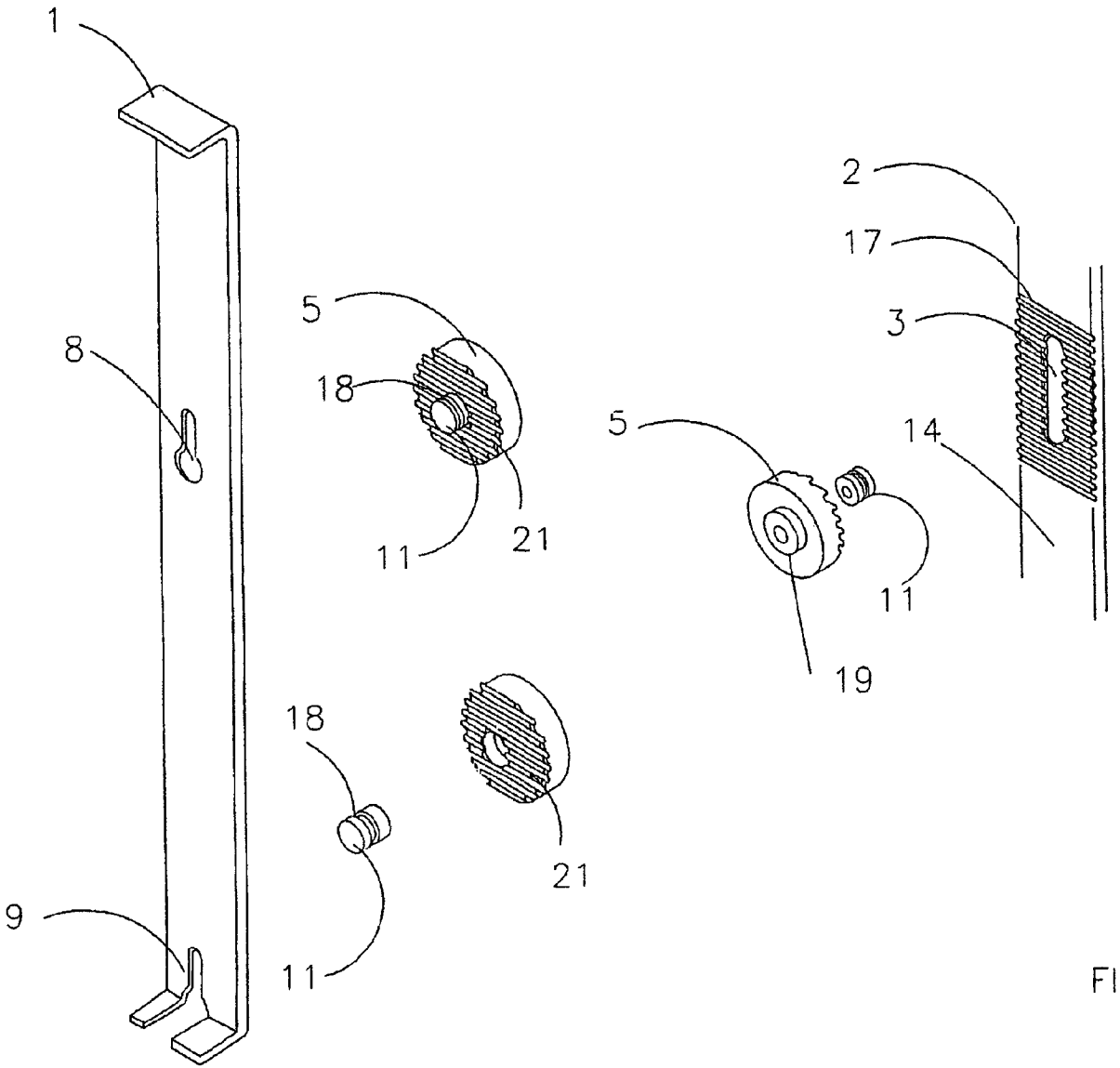
FIG. 4 is, in perspective view, the locking components of the ladder leveller.

The leg assembly as shown in FIG. 2, complete with channel 2, and locking bar guides 4 secured by rivets 16, and locking bar 1 is attached to the ladder by bringing the assembly of FIG. 2 to a ladder stile as shown in FIG. 1 so that the locking pins 11 pass through the channel slots 3 and the locking bar slots 8 and 9 until the grooves 17 in the channel engage with the grooves 21 in the collars. The locking bar 1 is then moved towards the foot of the ladder engaging the locking bar slots 8 and 9 in the locking pin 11 slots 18. Similarly a second ladder leveling device may be optionally attached to the opposite stile.

To adjust the ladder leveling device one lifts the locking bar 1 until the locking bar slots 8 and 9 disengage the locking pin grooves 18 allowing the leg assembly to move away from the ladder stile 20 enough for the channel grooves 17 and the collar grooves 21 to clear. The leg assembly is then moved towards or away from the foot of the ladder to the desired position, the leg assembly is moved towards the ladder style 20 until the channel grooves 17 and collar grooves 21 are once again engaged. The locking bar 1 is then moved towards the foot of the ladder stile 20 engaging the locking pin 11 in groove 18 by the locking bar slots 8 and 9. Once the locking bar 1 is fully engaged in the locking pin grooves 18, the ladder can be positioned and used as shown for example in FIG. 8.

Figure 9:
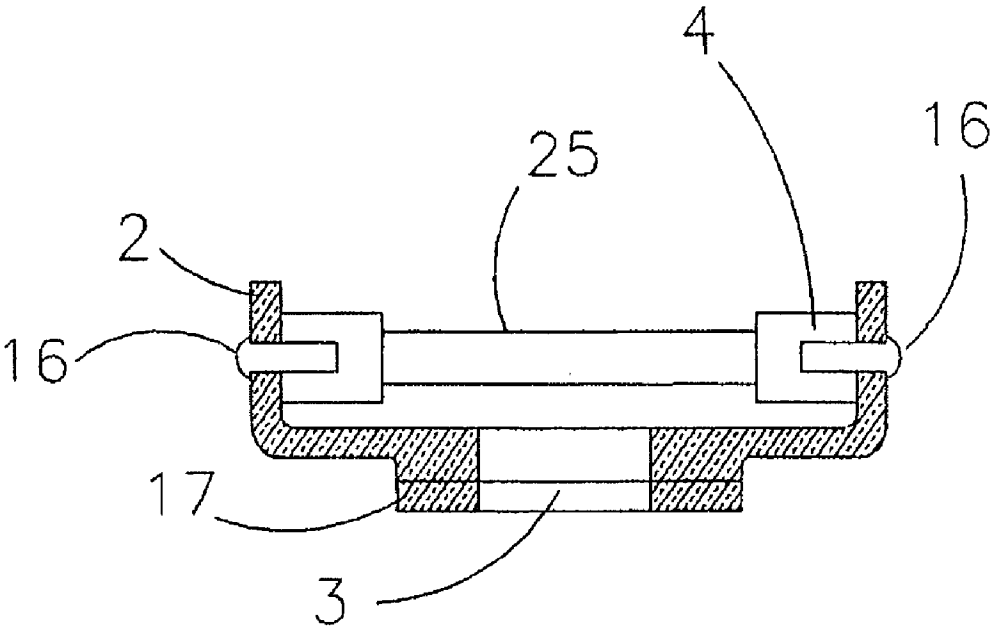
FIG. 9, is in top cross sectional view, the ladder locking bar guides.

The combination of the cylindrical grooves 25 on the locking bar guides as shown in FIG. 9, and the key hole slot 8 and 9 on the locking bar enables the key hole slots 8 and 9 to engage the groove 18 of the locking pin 11. The locking bar 1 is pushed down through the locking bar guides 4 until the top end of the key hole slot 8 and 9 slide until the bar fully engages the top half circumference of pin slot 18. The locking bar 1 will not engage the collar pin 11 if the grooves between the collar 21 and the channel 17 are misaligned, signaling to the user that the ladder leveller is not locked in position and is not safe to use.

The ladder collar 5 may be made of insulating material so as to provide an extra measure of protection against unintentional grounding of the ladder when used in servicing electrical devices, which may be energized at the time. The combination of the insulated collar and centrally locating this steel threaded rod inhibits an electrical charge passing through the attachment to the ladder body. The locking pin 11 is shown as a separate component from the collar 5, and can be metallic in nature adding strength to the locking mechanism. An alternative embodiment may have the collar 5 and locking pin 11 combined as a single component that could be made of a high strength electrically insulating material such as plastic, or it could be made of a metallic material which may simplify the design while possibly forgoing the electrical insulating properties of the collar 5.

Figure 5:
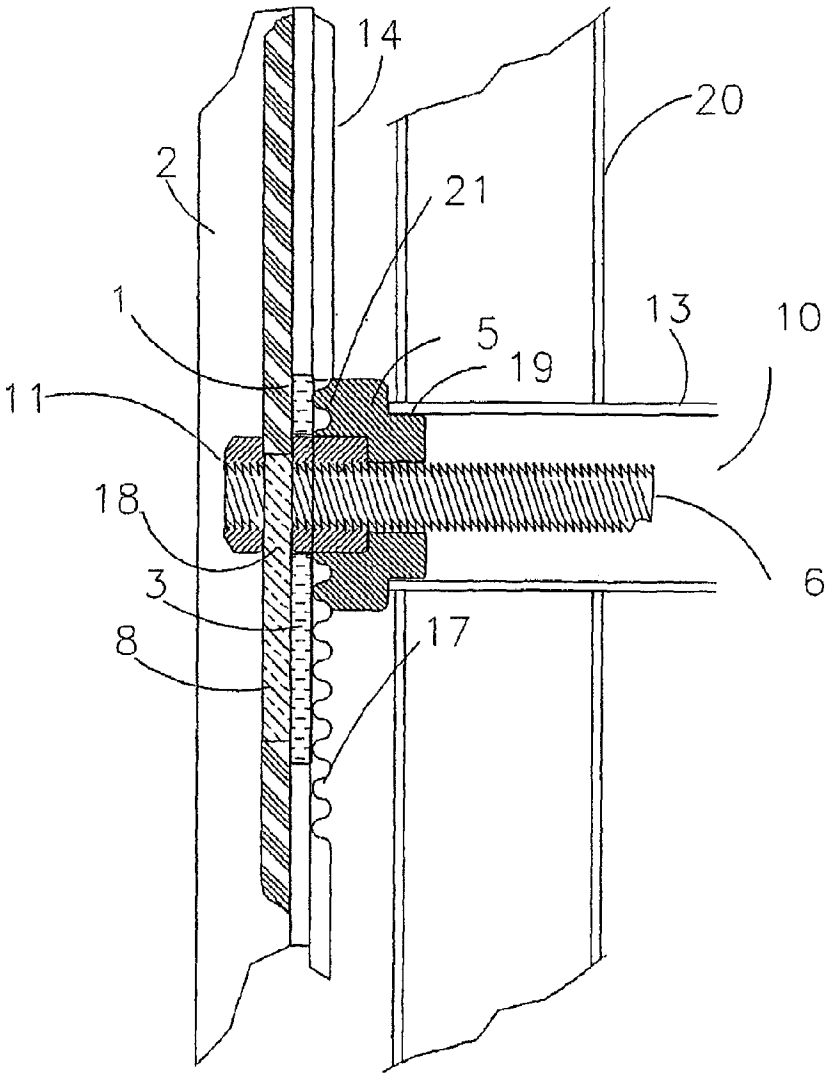
FIG. 5 is, in side cut-away view, the mounting interface between ladder stile, rung port and ladder leveller.
Figure 5A:
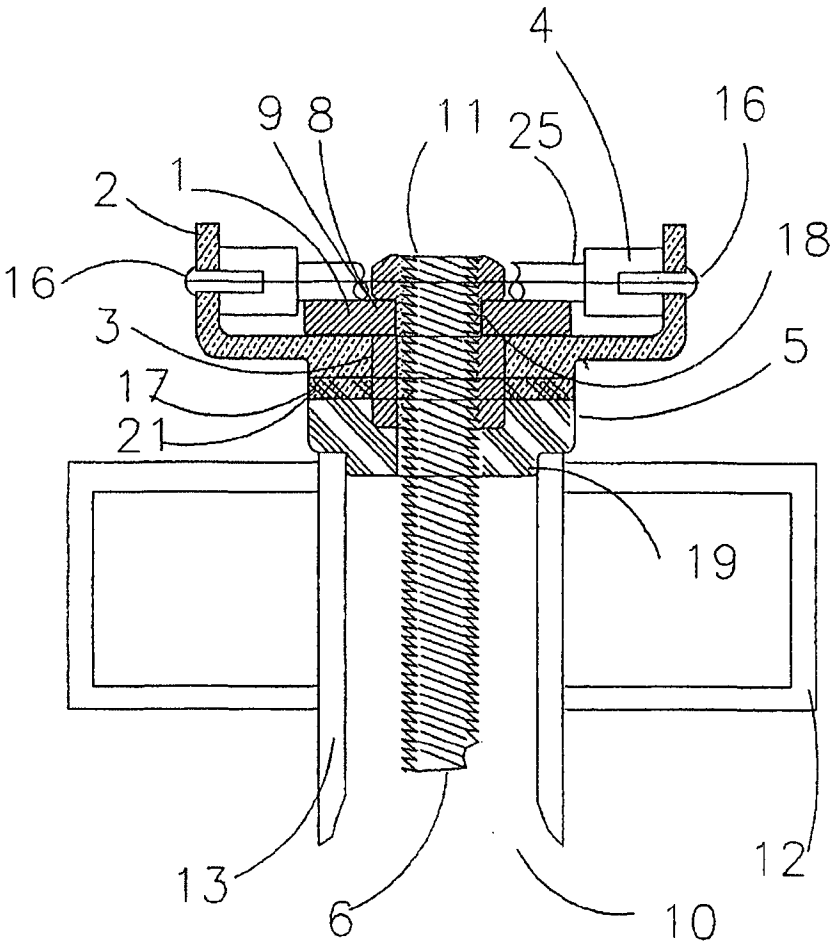
FIG. 5*a* is, in top cut-away view, the mounting interface between ladder stile, rung port and ladder leveller.
Figure 6:
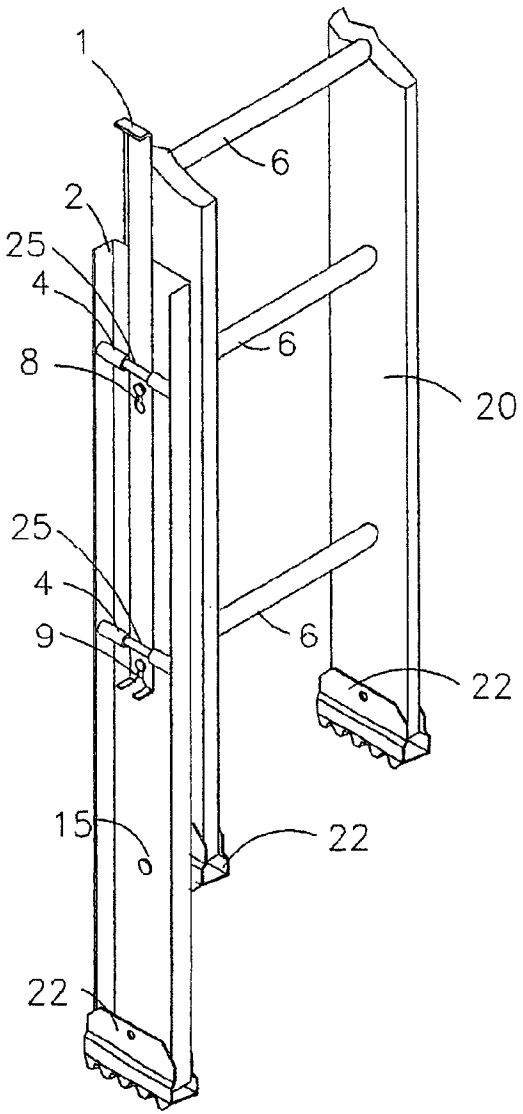
FIG. 6 is, in perspective view, a ladder with a ladder leveller attached to one stile in a extended position with the locking bar engaged.
Figure 7:
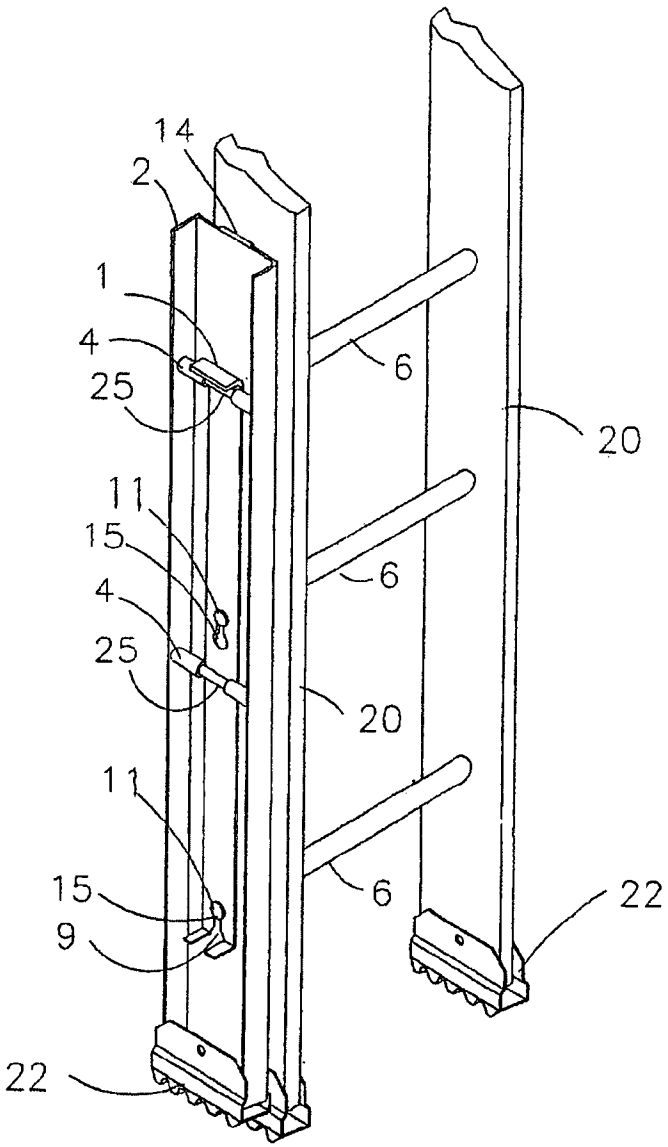
FIG. 7 is, in perspective view, a ladder with a ladder leveller attached to one stile in a retracted or stowed position with the locking bar engaged.
Figure 8:
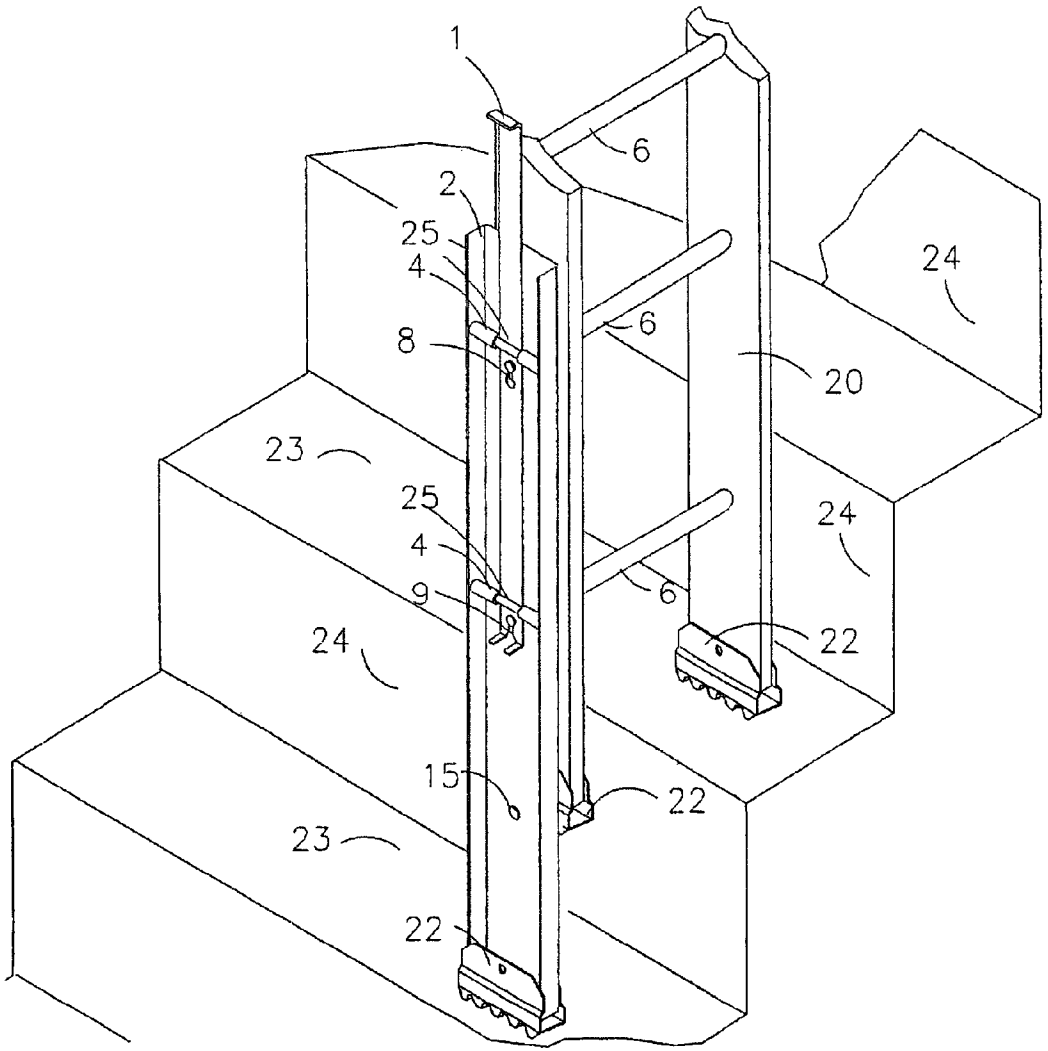
FIG. 8, is in perspective view, a ladder with a ladder leveller installed and extended to support the ladder on a set of stairs.

FIGS. 5 and 5*a* show the ladder collar 5 securely engaging the ladder port 10 and stile 20 by means of the protrusion or locating ring 19 on the collar 5 seating within the ladder port 10, while the shoulder portion of the collar engages the surface of the stile 20, and is held in contact with the stile 20 by the pressure resulting from two such collars 5 being turned onto the threaded rod 6 until they both actively engage the opposing rung ports 10 with the collar locating ring 19, and the stile 20 with the shoulder portion of the collar.

FIGS. 5 and 5*a* also show by top view cutaway section the channel 2 grooves 17 and 21 engaged, and the locking bar 1 slot 8 engaged with the locking pin 11 groove 18. The locking bar 1 is also shown entrapped by the locking bar guides 4 which are riveted 16 to the channel 2.

Non-slip rubber pads on the swivel feet 22 are typically installed at the foot of the ladder levellers by bolting through hole 7 on the channel 2, providing the ladder leveller additional safety through both non-slip and electrical insulation properties of the feet. The rotational degree of freedom in the mounting of the feet 22 enhances the ladder safety when used on different ladder slopes.

The u-shaped channel 2 is used for legs in the present invention due to its improved strength and weight characteristics when compared with much of the prior art. The present invention may be installed onto a conventional hollow rung ladder without the use of tools, modification of the ladder, or interference with the ladder operation. It is may be adjusted without tools by simply lifting and lowering the locking bar 1. The ladder leveller may be moved from one side of the ladder frame to the other side with out the use of tools, and is not restricted to specific ladder widths making it a flexible add on to most existing ladder designs.

The insulated ladder collar separates the ladder leveller from the main ladder frame and is non-conductive, adding a measure of safety when used around energized electrical circuits. The ladder leveller has two connecting points to the ladder, spreading the stress over a greater area than some of the prior art. There is no contact between the ladder frame and the ladder leveller leg, other than through the insulated collar, which distributes the load through the rung port. The grooves on the insulated collar and the grooves on the ladder leveller channel positively lock into each other to provide very secure support. The locking bar prevents unintended unlocking as it has to be lifted up in a vertical direction and is generally held in place through friction and gravity. The ladder leveller does not interfere with the clear operation of the ladder at any time. No tools are required for installation or removal of the ladder leveller, making it easy to move from one ladder to another.

The tightening and the precise alignment of the two insulated collar grooves on the ladder to engage the locking bar 1 is done without tools using the following method. The ladder attachments lower slot and grooves are engaged on the lower collar and the locking bar in slid into place. The attachment is rotated around in a circular arc securing the insulated collar against the face of the ladder style. The attachment is rotated again till the upper insulated pin aligns with the upper corresponding slot and passes through. The process is followed for the upper insulated collar and when complete the ladder grooves are now aligned exactly and the locking bar and corresponding grooves can be engaged properly.

Figure 10:
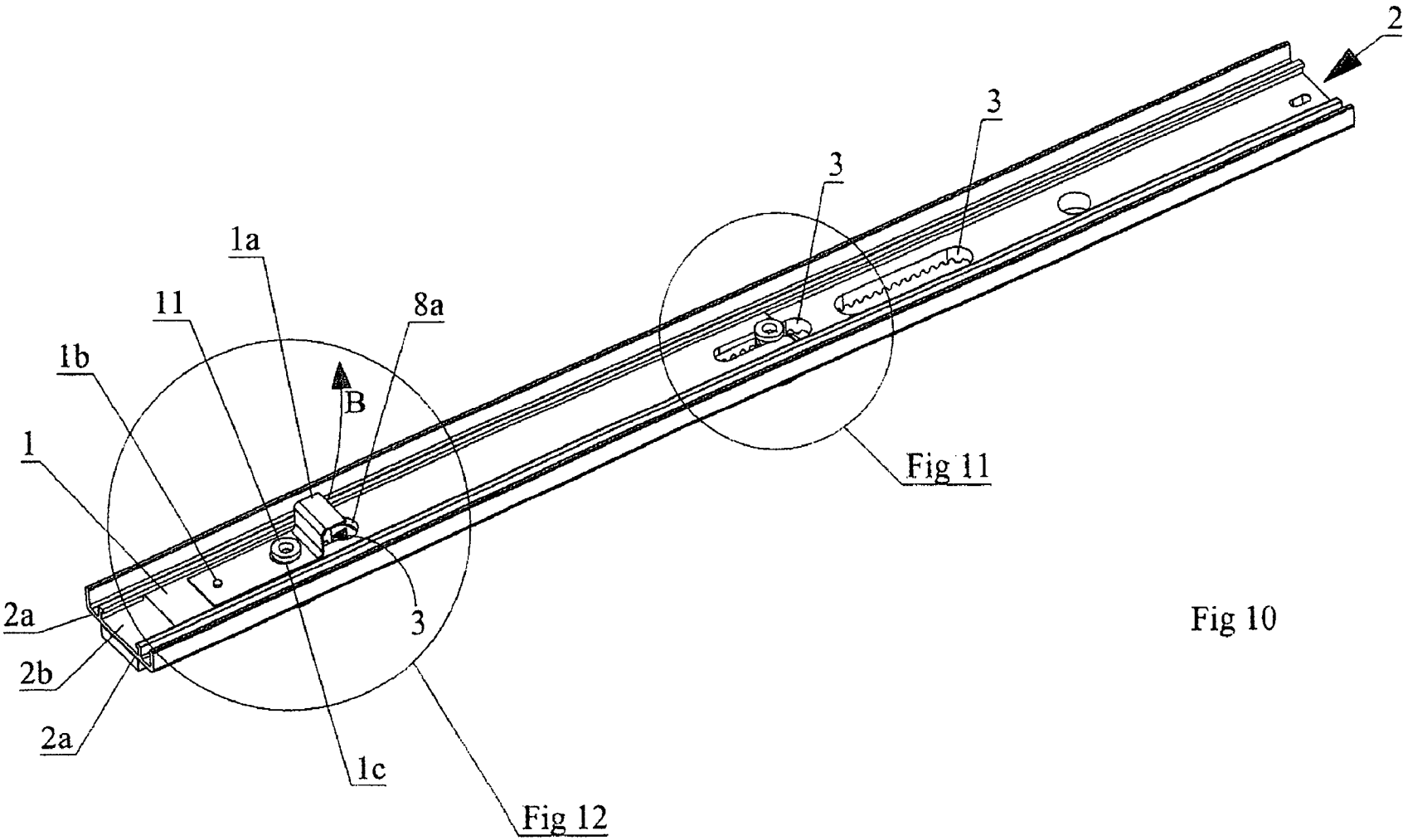
FIG. 10 is, in perspective view, an alternative embodiment of the channel and locking bar according to the present invention.
Figure 10A:
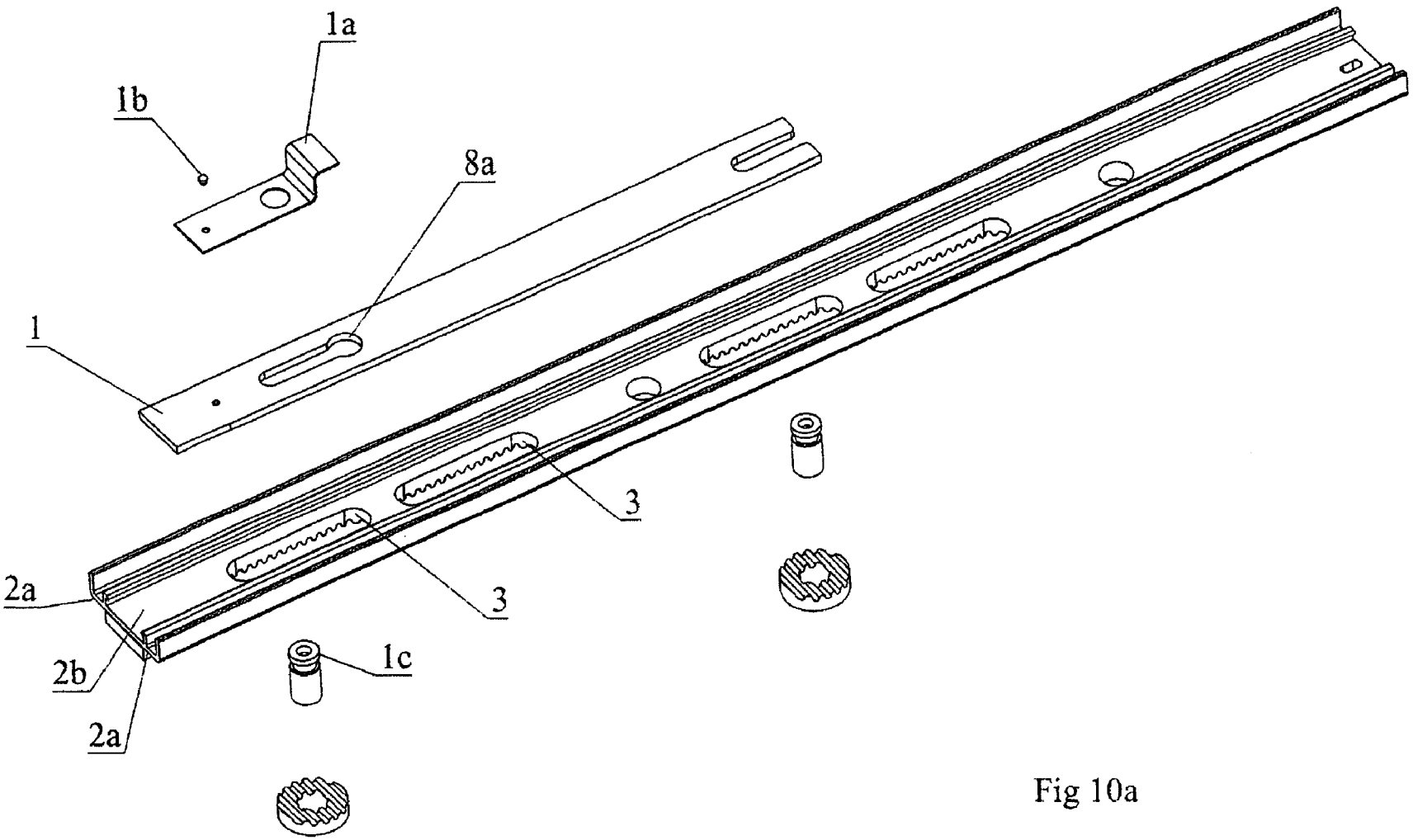
FIG. 10*a* is, in exploded view, the channel and locking bar of FIG. 10.
Figure 11:
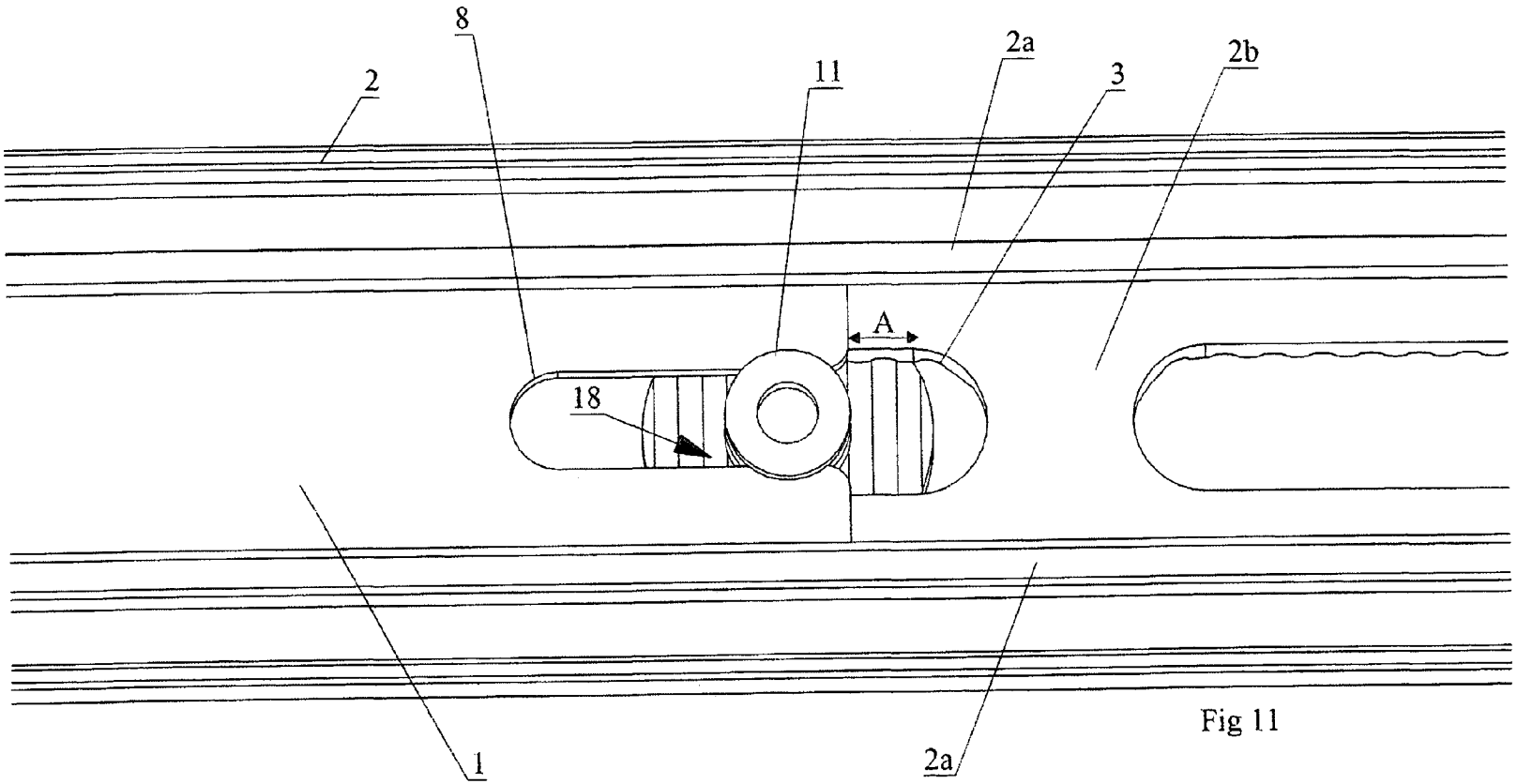
FIG. 11 is an enlarged view of a portion of FIG. 10.
Figure 12:
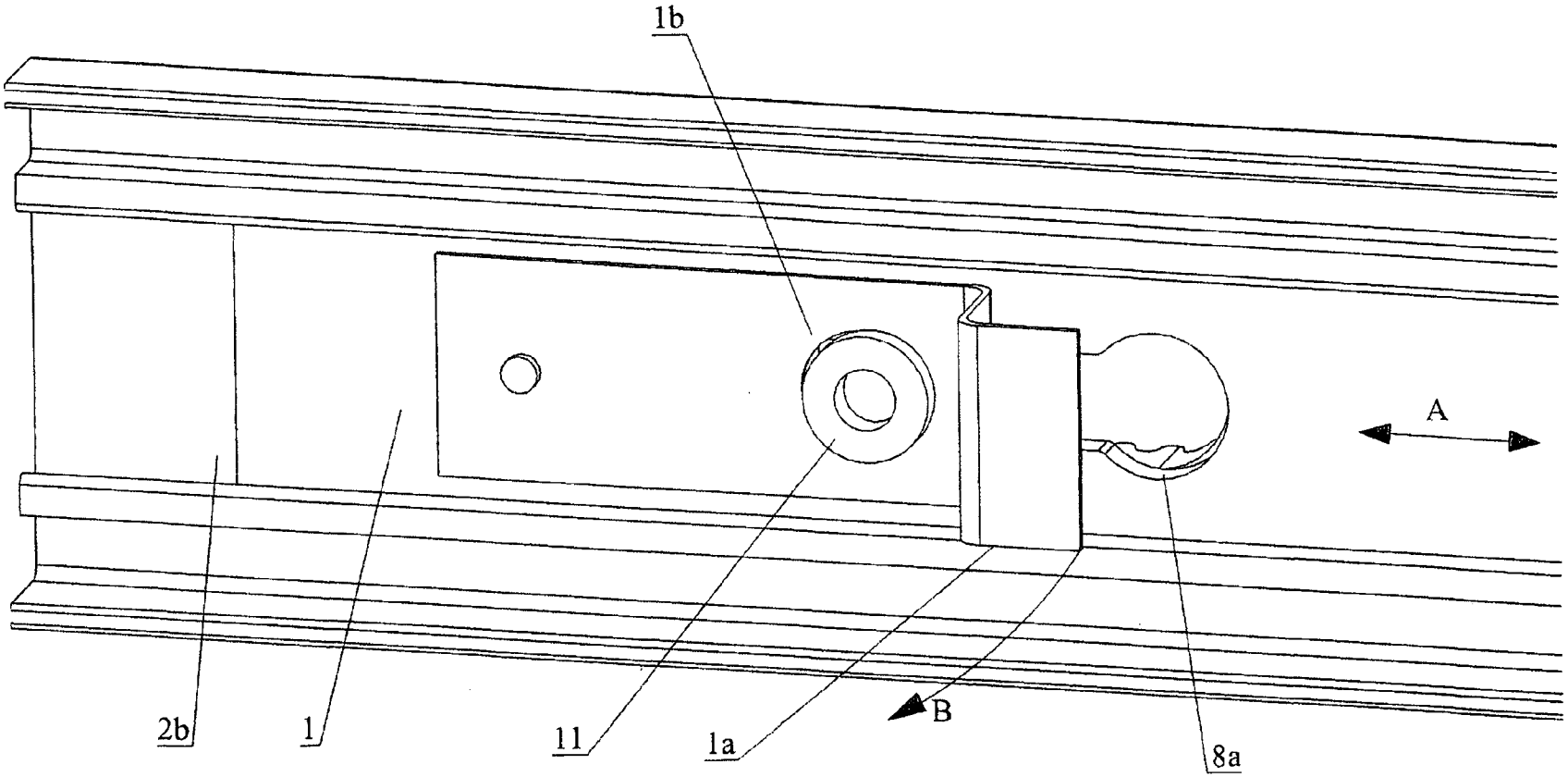
FIG. 12 is an enlarged view of a portion of FIG. 10.

In an alternative embodiment seen in FIGS. 10–12, the lower end of locking bar 1 is planar and slides along channel 2 under an opposed facing pair of channel rails 2*a* so that locking bar 1 is held snugly flush against the web 2*b* of channel 2 as the locking bar is slid along channel 2 in direction A. Locking bar 1 has key slot 8 so as to engage a locking pin 11 extending from collar 5 through channel slots 3 in channel web 2*b*. The narrowed slot 8*b* of key slot 8 engages corresponding slots 18 in locking pins 11.

A flexible latch bar 1 a is mounted by fastener 1*b* to channel web 2*b* at one end of the latch bar so as to flexibly dispose the free end of the latch bar over the lower of the key slots 8. Latch bar 1*a* has an aperture 1*c* in the free end thereof sized to fit snugly over the exposed end of locking pin 11. Thus, once the exposed end of locking pin 11 is inserted through the large opening 8*a* in key slot 8, and with the free end of latch bar 1*a* elevated away from locking bar 1 in direction B, locking pin 11 may be slid along the narrow slot 8*b* of key slot 8 until aligned with aperture 1*c* in latch bar 1*a*. Latch bar 1*a* may then be lowered so as to journal the exposed end of locking pin 11 through aperture 1*c*. This locks locking pin 11 into key slot 8 until such time as it is desired to remove locking bar 1 from engagement with locking pin 11. When it is desired to remove locking bar 1, the free end of latch bar 1*a* is elevated in direction B to allow locking pin 11 to be removed from aperture 1*c*, thereby allowing locking pin 11 to be slid along locking bar 1 into the opening 8*a* of key slot 8 for removal of locking pin 11 through opening 8*a*. This allows disengaging of locking bar 1 from locking pin 11 thereby allowing the removal of channel 2 from engagement with the corresponding stile 20 of ladder 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A ladder leveller for mounting onto at least one stile of a hollow runged ladder, the leveller comprising:

an elongate stile extension member, a spaced array of apertures formed along said stile extension member, each aperture of said array extending through said stile extension member, at least one cross bar sized for mounting journalled through a hollow rung of the ladder, a cross bar mount mountable onto an end of said at least one cross bar in mating engagement with an end of the hollow rung so as to secure said at least one cross bar journalled in the hollow rung, a locking pin extending from said at least one cross bar and cross bar mount so as to extend co-axially from said at least one cross bar and through any one of said apertures in said stile extension member so that said locking pin is exposed outwardly of said stile extension member oppositely disposed relative to the ladder when said stile extension member is abutted against, so as to lie along, the corresponding stile, a locking bar releasably mounted onto said locking pin when extending through an aperture in said stile extension member, said locking pin having locking grooves for interlocking with said locking bar, wherein with said at least one cross bar mounted through a corresponding hollow rung, and with the cross bar mount mounting said at least one cross bar securely in the rung, and with the locking pin protruding outwardly of the stile, and with the stile extension member mounting along and adjacent the stile with the annular collar protruding through one of said apertures in said stile extension member so as to expose said locking grooves on said annular collar outwardly of said stile extension member, and with said locking bar mated onto said locking grooves on said annular collar, said stile extension member is releasably mounted to and along the stile so as to adjustably extend from a lower end of the stile.

2. The leveller of claim 1 wherein said at least one cross bar includes two cross bars mountable through rungs at the lower end of the ladder, each cross bar of said two cross bars having corresponding said cross bar mounts and locking pins.

3. The leveller of claim 2 wherein said cross bars extend to opposite ends of the corresponding hollow rungs, and wherein said cross bar mounts mount to opposite ends of each said cross bar and corresponding rung, and said locking pins are mounted to, so as to extend oppositely from, said opposite ends of said each said cross bar and corresponding rung.

4. The leveller of claim 3 wherein said locking bar is an elongate rigid member having slotted apertures therein spaced apart so as to coincide with spacing between two of said locking pins extending from corresponding said two cross bars, wherein said slotted apertures in said locking bar mount simultaneously over said two of said locking pins so as to engage said locking bar into releasable locking engagement with corresponding said locking grooves in said two of said locking pins.

5. The leveller of claim 4 wherein at least one stop is mounted on said stile extension member and engageable with said locking bar to limit travel of said locking bar along said stile extension member as said locking bar is mounted into engagement with said locking pins.

6. The leveller of claim 3 wherein said cross bar mounts are electrically insulating and mount onto exposed ends of said cross bars, and wherein said cross bars are of sufficient length to extend outwardly of the corresponding rung so as to expose ends thereof for mounting of said mounts thereto, and wherein said mounts mount between said stile extension member and corresponding stile to insulate one from the other.

7. The leveller of claim 6 wherein said mounts have outwardly disposed surfaces, disposed outwardly of the corresponding stile, and wherein said outwardly disposed surfaces are contoured for inter-locking engagement with a correspondingly contoured surface on said stile extension member so as to inhibit slipping of said stile extension member along the corresponding stile when said stile extension member is mounted thereto.

8. The leveller of claim 7 wherein said contoured surfaces are corrugated.

9. The leveller of claim 3 wherein said stile extension member is a channel member u-shaped in cross section so as to form an elongate channel along the length of said member, and wherein said locking bar when mounted onto said annular collars is contained within said elongate channel.

10. The leveller of claim 1 further comprising an elongate resilient latch bar mounted at one end thereof onto said locking bar, wherein said locking bar includes an aperture therethrough disposed underneath a free end of said latch bar, said aperture in said locking bar sized to mate over said locking pin so as to allow said locking pin to extend therethrough, said latch bar having a mating aperture in said free end thereof for mating over said exposed locking pin exposed through said aperture in said locking bar, wherein said free end of said latch bar is biased away from said locking bar against a return biasing resiliency of said locking bar so as to mount said mating aperture onto said locking pin, and wherein said free end of said latch bar, once released, is resiliently biased so as to return towards said locking bar to thereby releasably lock said locking pin in said mating aperture, thereby mating said locking bar in a locked position relative to said stile extension member and thereby releasably locking said stile extension member onto the corresponding stile of the ladder.

11. The leveller of claim 10 wherein said aperture in said mating bar is a key slot, and wherein said mating aperture in said latch bar is positioned over a narrow end of said key slot, said narrow end of said key slot engaging said locking grooves in said locking pin.

12. The leveller of claim 11 wherein a handle is formed on said free end of said latch bar adjacent said mating aperture, said handle for grasping by a user so as to bias said free end of said latch bar away from said locking bar.

* * * * *